US005936196A

United States Patent [19]

Dawson

[11] Patent Number: 5,936,196

[45] Date of Patent: Aug. 10, 1999

[54] EXPLOSIVE FORMULATIONS

[75] Inventor: Ralph Edward Dawson, Kingsport, Tenn.

[73] Assignee: Eastman Chemical Co., Kingsport, Tenn.

[21] Appl. No.: 09/107,300

[22] Filed: Jun. 30, 1998

Related U.S. Application Data

[62] Division of application No. 08/844,717, Apr. 18, 1997

[60] Provisional application No. 60/016,818, May 3, 1996.

[51] Int. Cl.[6] ..... C06B 25/34

[52] U.S. Cl. ..... 149/92; 149/11

[58] Field of Search ..... 149/11, 92

[56] References Cited

U.S. PATENT DOCUMENTS

| | | | |
|---|---|---|---|
| 2,960,393 | 11/1960 | Barr . | |
| 3,138,496 | 6/1964 | Monical . | |
| 3,266,957 | 8/1966 | Stresau . | |
| 3,281,292 | 10/1966 | Falcomer . | |
| 3,682,725 | 8/1972 | Cornelius . | |
| 3,888,707 | 6/1975 | Rothenstein | 149/92 |
| 4,163,681 | 8/1979 | Rothenstein et al. | 149/11 |
| 4,180,424 | 12/1979 | Reed . | |
| 4,357,185 | 11/1982 | Ringbloom . | |
| 5,067,996 | 11/1991 | Lundstrom et al. | 149/92 |
| 5,316,600 | 5/1994 | Chan et al. | 149/19.4 |
| 5,467,714 | 11/1995 | Lund et al. | 149/14 |
| 5,468,313 | 11/1995 | Wallace et al. | 149/53 |
| 5,529,649 | 6/1996 | Lund et al. | 149/92 |
| 5,547,527 | 8/1996 | Müller et al. | 149/11 |
| 5,712,511 | 1/1998 | Chan et al. | 149/92 |
| 5,739,325 | 4/1998 | Wardle et al. | 149/92 |

FOREIGN PATENT DOCUMENTS

| | | |
|---|---|---|
| 0 406 190 | 1/1991 | European Pat. Off. . |
| 574 271 | 1/1946 | United Kingdom . |
| 721 487 | 1/1955 | United Kingdom . |

OTHER PUBLICATIONS

Chemical & Engineering News, vol. 72, No. 3, Jan. 17, 1994, Washington, DC, USA, pp. 18–22, XP000418337 Borman: "Advanced Energetic Materials Emerge For Military and Space Applications".

Chemical Abstracts, vol. 119, No. 20, Nov. 15, 1993, abstract No. 206597j, A. Sikorska et al.: "Method of desensitizing crystalline explosives." p. 198; XP000372193.

Chemical Abstracts, vol. 114, No. 16, Apr. 22, 1991 abstract No. 146426n, Kobayashi et al.: "Injection molded explosive composition" p. 170; XP000186964.

*Primary Examiner*—Edward A. Miller

*Attorney, Agent, or Firm*—Staas & Halsey

[57] ABSTRACT

Composition comprising 2,4,6,8,10,12-hexanitrohexaazoisonurtitane (CL-20) coated with a shock sensitivity reducing agent whereby the shock sensitivity of the composition is reduced a statistically significant amount.

8 Claims, 1 Drawing Sheet

EXPLOSIVE FORMULATIONS

This application is a division of application Ser. No. 08/844,717 filed Apr. 18, 1997, now pending and, in turn, the original application of provisional application No. 60/016,818 filed May 3, 1996.

BACKGROUND OF INVENTION

For over a decade, the military has been devoting a large amount of research and development funding to research projects directed to reducing the impact and shock sensitivity of the main explosive charge in munitions. A main challenge is to reduce sensitivity of the main explosive charge without decreasing performance while also not significantly increasing cost. One of the main charge explosives in munitions formulations is a caged nitramine compound. The chemical name of the compound is 2,4,6,8,10,12-hexanitrohexaazoisonurtitane (CL-20). The only known practical way to reduce the sensitivity of these formulations is to increase the amount of inerts and less sensitive components therein and thus decrease the sensitivity of the formulation but this also reduces the performance of the formulation. Further, extensive discussion of this problem is set forth in U.S. Pat. No. 4,842,659. In this patent it is stated that insensitive munitions must be developed to improve the combat survivability of an armament vehicle. It has been found that munitions utilized in some weapon systems are vulnerable to sympathetic detonation. For instance, the cannon caliber ammunition stored aboard these vehicles is vulnerable to initiation via shape charge jet and then propagation of the reaction due to sympathetic detonation.

This sympathetic detonation and propagation scenario can be summarized as follows: If a round is hit by a shape charge jet, it is initiated. As a result, the fragments that are generated by the blast then strike the other rounds that are adjacent to it. The latter rounds then initiate, contributing to the overall reaction and damage sustained by the vehicle, crew, and other munitions. The mechanisms of reaction for the initiation of the surrounding rounds are due to the blast and fragments impinging on the aforesaid adjacent round. The probability of sympathetic detonation can be reduced in several ways. This can be done by reconfiguring the ammunition compartments within the vehicle. It can also be accomplished by packaging the ammunition with anti-fratricide materials. However, each of the aforesaid solutions will reduce the amount of space available for the storage of ammunition. The most acceptable solution to the problem is to reduce the sensitivity of the energetic material to sympathetic detonation. Incorporating less sensitive energetic material will reduce the vulnerability of initiation from the cited threats without reducing the number of rounds stored in the vehicle. It has been found that by reducing the vulnerability to sympathetic detonation of the energetic materials used in these munitions, the probability of catastrophic reaction can be minimized.

The mechanism generally accepted within the explosives community for detonating or deflagrating explosives is the creation of very localized regions of high temperature, i.e., hot spots. The application of impact or shock on the explosive can generate hot spots in the following ways: (1) by adiabaticly compressing air (or explosive vapor) bubbles trapped in or purposely introduced into the explosive, (2) by intercrystalline friction, (3) by friction of the impacting surfaces, (4) by plastic deformation of a sharply-pointed impacting surface, and (5) by viscous heating of the impacted material as it flows past the periphery of the impacting surfaces.

In the compression and movement of explosive crystals due to impact or shock, explosives like CL-20 rapidly evolve into simpler products as well as free radicals and unstable intermediates. This mixture of products is believed to be unstable and subject to detonation when exposed to a low intensity shock induced spark of static electricity. The creation and build-up of static electricity may be an additional source of energy which contributes to the detonation of the explosive and its decomposition products.

BRIEF SUMMARY AND OBJECTS OF INVENTION

The present invention is directed to CL-20 formulations in which the CL-20 is coated with shock sensitivity reducing agents to reduce the shock sensitivity of CL-20.

Agents which were found to be useful in this invention were from four primary classes of compounds. The classes are: 1) Quaternary Ammonium Salts; 2) Anionic Aliphatic and Aromatic Compounds; 3) Fatty Acid Esters; and 4) Amine Derivatives;

"Quaternary ammonium salts" are cationic nitrogen containing compounds with four various aliphatic or aromatic groups. The selected anion is generally a halogen, acetate, phosphate, nitrate, or methosulfate radical. Inclusive in this category are quaternary imidazolinium salts where two of the aliphatic group bonds are contained within the imidazole ring.

"Anionic aliphatic and aromatic compounds" are compounds normally containing a water insoluble aliphatic group with an attached hydrophilic group. They are often used as surfactants. The hydrophilic portion of these anionic compounds is a phosphate, sulfate, sulfonate, or carboxylate; sulfates and sulfonates predominate.

"Fatty acid esters" is a term used broadly that covers a wide variety of nonionic materials including fatty esters, fatty alcohols and their derivatives. Although once limited to compounds obtained from natural fats and oils, the term "fatty" has come to mean those compounds which correspond to materials obtainable from fats and oils, even if obtained by synthetic processes. They can generally be subclassified as: (1) fatty esters (e.g., sorbitan esters (e.g., mono- and diglycerides)), (2) fatty alcohols, and (3) polyhydric ester-alcohols. The exact classification of these compounds can become quite confused due to the presence of multiple functional groups. For example, ethers containing at least one free —OH group fall within the definition of alcohols, (e.g., glycerol-1,3-distearyl ether). Synthetic compounds such as polyethylene glycol esters can also be included in this category.

"Amine derivatives" describes a wide variety of aliphatic nitrogen bases and their salts. Amines and their derivatives may be considered as derivatives of ammonia in which one or more of the hydrogens have been replaced by aliphatic groups. Preferred amine salts are formed by reaction with a carboxylic acid to form the corresponding salt. The amine and the carboxylic aliphatic groups can be unsubstituted alkyl, alkenyl, aryl, alkaryl, and aralkyl or substituted alkyl, alkenyl, aryl, alkaryl and aralkyl where the substituents are groups consisting of halogen, carboxyl, or hydroxyl.

Agents evaluated are presented in Table 1 of the example. The focus in obtaining these materials was availability and toxicity. Secondarily, water insolubility was highly desired due to ease of incorporation into existing explosives manufacturing processes.

The agents listed in Table 1 were classified in accordance with the four primary classifications listed above. Classification of some of the agents were assumed based upon MSDS information since the exact chemical structure was proprietary. Agents were obtained representing all four categories. Compounds from all three subclassifications referenced above for the fatty acid esters are also represented. The list of possible compounds that can be employed within these categories is almost infinite due to the aliphatic group size, structure (branched or straight), additional functional groups, quantity, combination, and arrangement. Since the evaluation could become endless, agents were chosen to represent the widest variety practical within each chosen category.

It is an object of this invention to reduce the impact and shock sensitivity of CL-20 formulations without significantly reducing the performance of the main charge explosive.

It is another object of this invention to reduce the sensitivity of CL-20 formulations without significantly increasing the cost of manufacturing the CL-20 formulations.

Other objects and variations of this invention will become obvious to the skilled artisan from a reading of the following detailed specification.

DETAILED DESCRIPTION OF THE INVENTION

Figure 1:
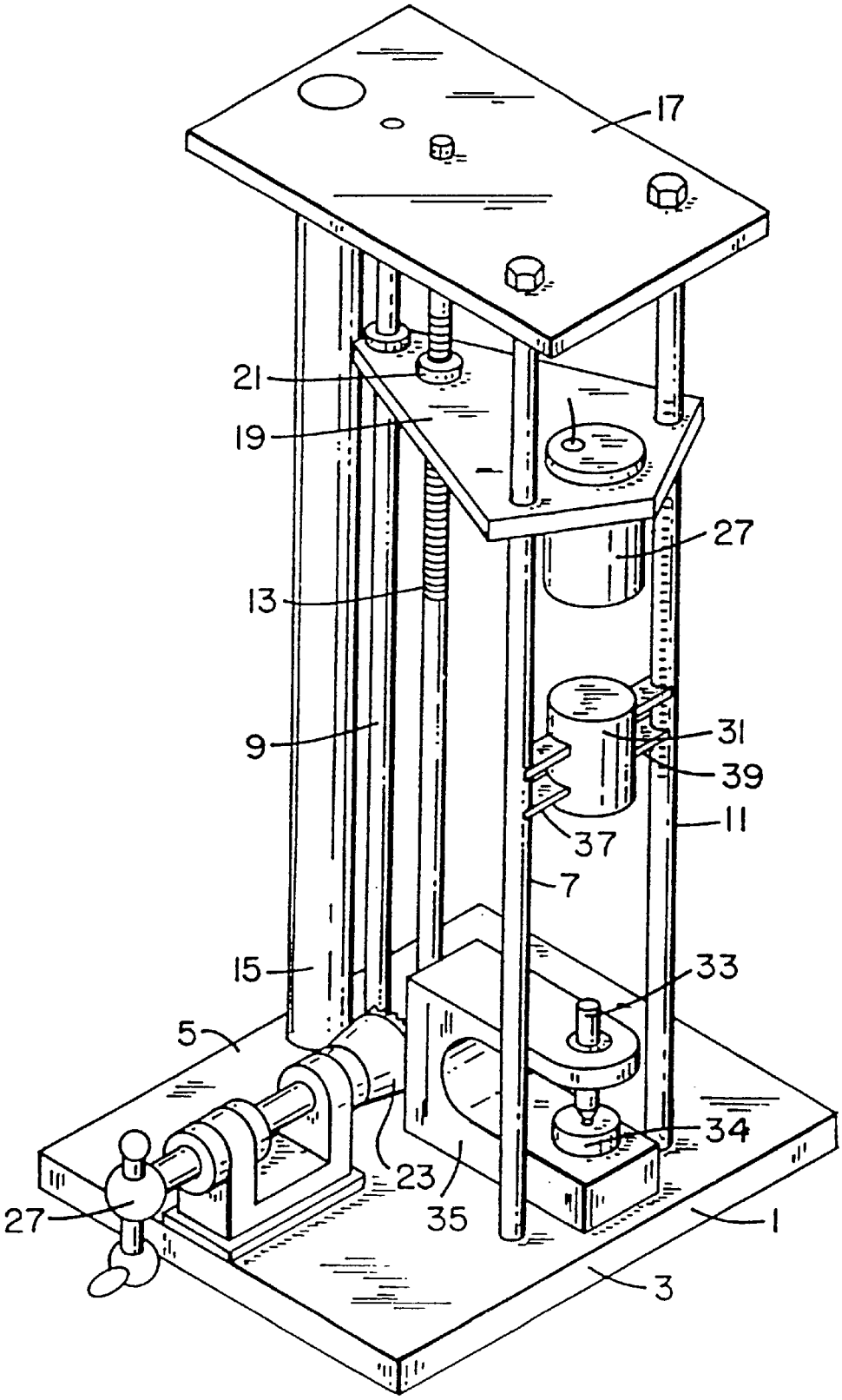
FIG. 1 is a pictorial view of the HDC Impact Machine.

The invention is a high energy explosive formulation characterized by reduced susceptibility to impact and sympathetic detonation due to shock forces, the formulation comprising CL-20 and a shock sensitivity reducing agent, the shock sensitivity reducing agent being present in an amount effective to impart an increase in HDC Impact Value to the formulation which is statistically significant. A HDC Impact Value of 21.03 centimeters has been found to be statistically significant for CL-20. The shock sensitivity reducing agent may be a quaternary ammonium compound; an anionic aliphatic or aromatic compound; a fatty acid ester; or a long chain amine.

Preferred quaternary ammonium compounds have the formula

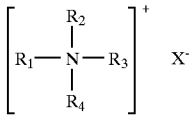

wherein $R_1$ is hydrogen, alkyl having 8–22 carbon atoms, aryl having 6–30 carbon atoms, alkaryl having 7–30 carbon atoms, aralkyl having 7–30 carbon atoms, or $H(OCH_2CH_2)_n$ wherein n is 1 to 50,

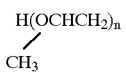

wherein n is 1 to 50, alkaryl having 8–20 carbon atoms, or hydroxyethyl. $R_2$ is the same as $R_1$, $R_3$ is hydrogen, alkyl having 1–22 carbon atoms, aryl having 6–30 carbon atoms, $H(OCH_2CH_2)_n$—wherein n is 1 to 150, or hydroxyethyl, $R_4$ is hydrogen or alkyl having 1–4 carbon atoms, and $X^-$ is halogen, carboxylate having 2–22 carbon atoms, nitrate, sulfate, methosulfate or phosphate.

Other preferred quaternary ammonium chloride formulations are bis(hydrogenated tallow alkyl) dimethyl quaternary ammonium chloride; $(CH_3)_3N^+R\ Cl^-$, wherein R is a mixture of long chain aliphatic and unsaturated aliphatic alkyl groups containing 14 to 18 carbon atoms;

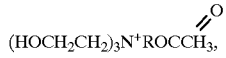

wherein R is a mixture of aliphatic and unsaturated aliphatic alkyl groups containing 14 to 18 carbon atoms;

dimethyl di(cocoalkyl) quaternary ammonium chloride; $R_2N^+(CH_3)_2\ Cl^-$, wherein R is $C_6$–$C_{18}$ alkyl and unsaturated alkyl groups; and $R_3N^+CH_2CH_2(OCH_2CH_2)_nOH\ Cl^-$, wherein R is methyl and n is 1–250.

A preferred anionic aliphatic shock sensitivity reducing compound is sodium alkane sulfonate where the alkane group has 6–18 carbon atoms.

A preferred anionic compound is a soap or detergent based on the lithium, potassium or sodium salts of carboxylic acids containing about 8–26 carbon atoms or similar salts based on alkylbenzene sulfonates. Also the salt may be a triethanolamine salt of a carboxylic acid having about 8 to about 26 carbon atoms or triethanolamine salts based on alkylbenzene sulfonates wherein the alkyl groups contains 8–18 carbon atoms.

Preferred long chain amines are:

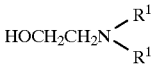

wherein $R^1$ is $C_{12}$–$C_{18}$;

$$[H(OCH_2CH_2)_nOCH_2CH_2]_2NR$$

wherein R is $C_{12}$ to $C_{18}$ and n is 1–150, and

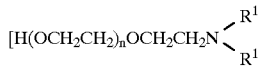

wherein $R^1$ is $C_{12}$ to $C_{18}$ and n is 1 to about 150. The long chain amine may be ethoxylated cocoalkyl amine where cocoalkyl is $C_8$–$C_{18}$ saturated or unsaturated group.

Preferred fatty acid esters are glycerol esters having the formula

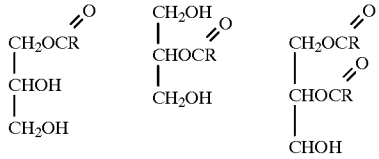

wherein R is about $C_8$ to $C_{18}$,

Other shock sensitivity reducing compounds useful in this invention are water soluble or water dispersible quaternary ammonium salts which include: Arquad 2HT-75 from Akzo Chemicals Inc. (bis(hydrogenated tallow alkyl) dimethyl quaternary ammonium chloride);

Arquad 2C-75 from Akzo Chemicals Inc., dimethyl di(cocoalkyl) quaternary ammonium chloride $R_2N^+(CH_3)_2\ C^-$ wherein R=$C_6$–$C_{18}$ alkyl and unsaturated alkyl groups;

Staticide 30006 from ACL Inc. (a quaternary ammonium compound) (Structure proprietary.)

Other useful quaternary ammonium salts are derived from diamines, triamines or polyamines.

For example quaternary ammonium salts derived from ethylenediamine; diethylenetriamine; hexamethylenediamine; 1-4 cyclohexane-bis-methylamine (can use cis, trans or cis/trans mixture); phenylenediamine. Typical salts would be hexamethyl ethylene diammonium chloride; hexamethylene phenylene diammonium sulfate; and dimethyl tetrahydroxyethyl 1-4 cyclohexylenedimethylene diammonium chloride.

Water soluble anionic aliphatic compounds and aromatic compounds which are useful include: Dehydat 93P from Henkel Corp. which is a sodium alkane sulfonate (alkane not specified but probably $C_8$–$C_{18}$)

Soaps or detergents useful are based on the lithium, potassium, sodium on triethanolamine salts of carboxylic acids containing 8 to 26 carbon atoms or similar salts based on alkylbenzene sulfonates.

Other useful salts include: sodium octanoate, sodium decanoate, sodium laurate, sodium myristate, sodium palmitate, sodium stearate, sodium oleate, sodium linoleate.

Also useful are sodium, lithium or potassium salts of mixed acids such as those obtained from tallow and coconut oil. A typical one would be a sodium salt of mixed acids containing 12, 14, 16 and 18 carbon atoms. Some typical useful alkylbenzene sulfonates include: dodecylbenzenesulfonic acid, dodecylbenzenesulfonic acid sodium salt, dodecylbenzenesulfonic acid triethylamine salt, nonylbenzenesulfonic acid, nonylbenzenesulfonic acid sodium salt, and mixed $C_{10}$ to $C_{13}$ alkylbenzenesulfonic acid salts. Useful sodium alkanesulfonates include sodium dodecanesulfonate, sodium stearylsulfonate, and sodium myristylsulfonate. Useful alkylnaphthalenesulfonate salts include sodium isopropylnaphthalenesulfonate, sodium nonylnaphthalenesulfonate. A useful a-olefin sulfonate is mixed 1-octene, 1-decenesulfonic acid sodium salt. A useful dialkyl sulfosuccinate is di 2-ethylhexyl sulfosuccinic acid sodium salt. A useful amidosulfonate is sodium N-oleoyl-N-methyl taurate. A useful sulfoethyl ester of fatty acid is sodium sulfoethyl oleate.

A useful alcohol sulfate is sodium lauryl sulfate. Ethoxylated alcohol sulfates such as sodium polyethoxyethylene sulfate; ethoxylated alkyl phenol sulfates; phosphate esters—usually used as a mixture of mono, di, and triester are useful in this invention.

Useful fatty acid esters are glycerol esters such as glycerol monostearate, glycerol distearate, and glycerol dilaurate which are usually a mixture of mono and diesters. Many products are derived from naturally occurring fats such as tallow, lard, cottonseed, safflower oil and the like and will be mixtures of fatty acids containing about 12 to about 18 carbon atoms.

Also useful are polyoxyethylene esters; amine derivatives, and bis(2-hydroxyethyl) tallow alkyl amine. Other operable amines include dialkylethanolamines in which the alkyl groups contain 12 to 18 carbon atoms; ethoxylated amines such as alkyl polyethoxyethylamines in which the alkyl group is about 12 to 18 carbon atoms, and ethoxylated cocoamine.

Shock sensitivity reducing agents useful in this invention exhibit anti-static properties.

Description of HDC Impact Machine

The impact sensitivity of CL-20 explosives is determined on a drop weight test machine comprising a mechanism for dropping a 5 kilogram weight from a chosen height on a selected sample of explosive. The sample weight is normally 0.025 or 0.035 grams. The sensitivity value is expressed as the height in cm from which the weight is dropped for the probability of an explosion to be 50 percent.

The HDC impact machine is shown in FIG. 1. The machine comprises metal base plate 1 which is generally square, about 16 inches per side, and is about one and one-half inches thick. On the base plate there are located three tapped holes to receive guide rods 7, 9 & 11. Two of the holes are located about four (4) inches from the front edge 3 of the base plate and three (3) inches on either side of a center line extending from the front edge 3 to the back on opposite edge 5 of the generally square base plate. The third hole is located on said center line about ten and one-half inches from the front edge 3. In the three holes are mounted two guide rods 7 and 9 and a graduated guide rod 11. The graduated guide rod 11 has centimeter graduations formed thereon and are used to indicate the height of a five kilogram weight used with the apparatus (discussed later herein). A guide rod 7 is mounted in a hole spaced about 4 inches from the front edge 3 of the mounting block 1. A guide rod 9 is mounted in the third hole formed in the base plate as described above. A fourth hole is formed in the base plate 1 to receive a lift rod 13. The hole is located eight and one-half inches from the front edge of said base plate. The lift rod 13 is threaded its full length and is mounted for rotation in a bearing (not shown) located in said fourth hole. A fifth hole is formed in the base plate centered and is three inches from the back edge of the base plate 1. In this hole is mounted a support rod 15.

A top plate 17 having the dimension of ten by thirteen inches is provided with holes positioned in the same configuration as the holes in the base plate for receiving the upper ends of the guide rods 7, 9 and 11, the lift rod 13 and the support rod 15 to space and hold all five rods parallel to each other.

A magnet retainer plate 19 is provided and has holes matching the pattern of those in the top plate 17 and the base plate 1, with the exception of the support rod receiving hole. The magnet retainer plate 19 is positioned between the base plate 1 and the top plate 17. Guide rod 7 and graduated guide rod 11 pass through the holes located on the front portion of the magnet retainer plate 19 and guide rod 9 passes through the hole located at the back of the magnet retainer plate. The lift rod 13 is threaded through a lift rod nut 21 which is attached to the magnet retainer plate over the corresponding hole in the plate. The lift rod is mounted in bushings for rotational movement to move the magnet retainer plate up and down between the base plate 1 and the top plate 17. The lift rod has a 45° miter gear 23 attached to its lower end adjacent the base plate 1 to cooperate with a second miter gear mounted on a ball crank shaft and handle 27 which will, when turned, rotate the lift rod 13 for moving the magnet retainer plate up and down as required.

Mounted on the magnet retainer plate 19 is an electromagnet 29 whereby the height of the magnet may be adjusted by the operator by turning the ball crank handle to move the magnet retainer plate 19 up or down as necessary.

A five kilogram weight 31 is provided and is adapted to be held by the electromagnet. The weight is provided with opposed flanges 37 which cooperate with guide rod 7 and graduated guide rod 11 whereby when the weight 31 is released from the electromagnet 29 the weight will freely fall to contact a plunger assembly 33 which strikes an anvil 34. Mounted on the base plate 1 is an anvil and plunger holder 35. The holder is attached to the base plate in a position to hold the anvil and plunger directly below the five kilogram weight so that the falling weight will strike the plunger which in turn will strike a sample located on the anvil. Also, a second anvil surface (not shown) is mounted in the bottom center of the five kilogram weight. The anvils are made from tool steel heat treated to 56 to 60 points Rockwell Hardness. The plunger 33 is made from tool steel heat treated to 56 to 60 points Rockwell Hardness. The plunger may be two inches in length overall, 0.50 inches in diameter and is tapered at near one end from 0.50 to 0.303 inches which extends for about 3/16 of an inch to form the striker portion of the plunger. Both ends of the plunger are ground to be perpendicular to the center line of the plunger. The anvils are cylinders which are one and one half inches tall and one and one quarter inches in diameter. The plunger is slidingly mounted in a bushing mounted in the plunger holder 35 which is centered directly over the second or bottom anvil 34.

In use the lift rod 13 is rotated to raise the electro magnet to preselected heights. The five kilogram weight will freely fall the preselected distance to strike the upper end of the plunger which in turn will strike a sample placed in a sample cup which is located directly below the small end of the plunger. The sample cup is made from brass and is 0.008 inches thick, 0.303 inches in diameter and 0.20 inches in height.

A detailed procedure for using the HDC Impact machine follows:

Interferences in the test may be: 1) a machine loosely assembled or not in proper alignment may produce incorrect values; 2) a rough surface or cracks on the anvil or plunger may produce low sensitivity values; 3) insufficient or unevenly distributed sample may produce incorrect values; 4) a sample containing glass, metal, or other gritty matter foreign to the product may produce low sensitivity values; and 5) wet samples or samples containing oil, grease, and or soft plastics may produce high sensitivity values.

Equipment needed is: 1) a sample splitter or glazed paper; 2) caps, percussion, 0.303 in diameter, 0.200 in height, and 0.008 inches thick; 3) spoon, loading, 0.025 and 0.035 gm; 4) spatula, wood; 5) tong, laboratory; 6) brush, approximately 2 inches wide; 7) oven, steam heated; and 8) a HDC Impact machine. The machine shall be tested with a sample having a known sensitivity range. The results are plotted on a control chart and corrections taken if the first point fails to plot within control limits or if 5 successive points all plot on one side of the center line.

Position 25 brass percussion caps, with open end up, on a flat surface. Fill the 0.025 gram loading spoon with the dry explosive and smooth off the excess by drawing a wooden spatula over the flat surface of the spoon. Dump the remaining portion into one of the prepared caps. Repeat Step 2 until each percussion cap is loaded. Ascertain explosives to be evenly distributed in each cap. Remove fumes and dust from the area of the impact machine. Using the laboratory tongs, place a loaded percussion cap on the anvil of the impact machine. While holdings the cap with the tong, insert the plunger through the guide hole above the anvil and into the percussion cap. Turn the electromagnet switch to the "ON" position. Adjust the height of the electromagnet by turning the ball crank handle until the base of the lower magnet arm coincides with the 35 cm mark on the guide rod 11. Lower the safety shield (not shown in drawing) and lift the weight vertically until it is held in place by the electromagnet. (The weight normally rests upon a safety shield while the machine is being charged). Face the opposite direction from the impact machine, turn the electromagnet switch to the "OFF" position, allowing the weight to fall and strike the top of the plunger. Lift the weight. Examine the percussion cap to determine if an explosion has occurred. An exploded cap is usually disintegrated; however, partial explosions may be determined by inspecting the cap for parts of the rim blown away. An explosion may also be recognized by a sharp report or by smoke in the area of the plunger. Clean all unexploded material and parts of the percussion cap from the anvil, plunger, and base plate with a brush or cloth. Repeat Steps 5 thru 12 raising the electromagnet 5 cm after each non-explosion and lowering the electromagnet 5 cm after each explosion. The first non-explosion after an explosion is considered as the starting point of the 20 tests. Record this height in cm. Raise the electromagnet 5 cm and repeat Steps 5 thru 12. Raise or lower the electromagnet as required and repeat the steps until 20 tests have been completed. Record each test result. Assume each test exploding at a recorded height would have exploded at greater heights. Assume each non-explosion at a recorded height would fail to explode at heights less than the recorded height. Perform calculations for impact value.

Calculation for Impact

1. Calculate the percentage explosions at a given height.

$$\text{Explosions, \%} = \frac{A \times 100}{B}$$

Where

A=Number of explosions at a given height

B=Total number of explosions and non-explosions at a given height

Record the percentage explosions.

2. Calculate the impact sensitivity as follows:

$$\text{Impact sensitivity, cm} = C - \frac{5(D-50)}{D-E}$$

Where

C=The lowest height in cm at which more than 50% explosions occurred.

D=Percentage explosions greater than 50%.

E=Percentage explosions less than 50%.

5=Difference in height in cm of each test.

The invention will be further illustrated by consideration of the following examples, which are intended to be exemplary of the invention.

EXAMPLE

Compositions comprising CL-20 and a series of shock sensitivity reducing agents were prepared according to the procedure set forth. The concentrations, the shock sensitivity reducing agents and the HDC Impact Value required for detonation at different concentrations of the agents in the CL-20 are shown in Table 1. Also there is indicated in the Table the calculated concentration required for the formulation to reach the statistically significant increase in the HDC Impact Value.

DSC scans were run on CL-20 and each agent. Sample size for the analysis was 4.5 to 5.5 mg. The analysis was performed on a DSC (Differential Scanning Calorimeter). Samples of CL-20 that were prepared for impact testing with a 3% addition of an agent were also analyzed by DSC to determine compatibility. None of the mixtures showed abnormal exotherms.

The CL-20 was coated with the water soluble agents by weighing 23.75±1.25 gms of the dry explosive with varying amounts of the agents to produce an end composition ranging from 0.10% to 6.00%. For the external coating, 5 ml of $H_2O$ was added to the weighed agent. The agent was added to the dry CL-20 and mixed in a 100 ml beaker for 5 minutes. The beaker and contents were placed in a steam heated oven (200° F.) for 15 minutes. The heating and stirring procedure was repeated until the explosive was dry. The standard HDC impact test was run on each prepared sample. The lab procedure is described herein.

A coating procedure was developed which took advantage of the low melting point (50–80° C.) of the water insoluble agents. The procedure consists of weighing 23.75±1.25 gms of the dried explosive into a 100 ml beaker. The agent was added to the beaker along with 5 ml of water. The mixture was placed in a steam heated oven at 200° F. for about 15 minutes which was enough time to melt the agent. The contents of the beaker were stirred for 5 minutes. The beaker was placed in the oven again. The heating and stirring procedure was continued until all the water had evaporated. Impact results indicate that this procedure produced homogenous samples.

One of the soluble agents chosen for the evaluation with CL-20 was bis(hydrogenated tallow alkyl) dimethyl quaternary ammonium chloride (2HT-75—Akzo Chemicals). CL-20 coated with this agent (2% of the product) had an impact of 24.20 cm.

One of the insoluble agents chosen for evaluation was distilled monoglyceride (PA 208—Eastman Chemical Company). The CL-20 containing 2% agent (2% of the product) had an HDC Impact Value of 22.03 cm as compared to 14.85 cm with no coating.

The statistically significant impact values set forth in the Table were determined as set forth.

A normal untreated CL-20 product has known average and standard deviation values when tested on a standard Holston Impact Machine. The impact value of a given sample would not be expected to be more than 3 standard deviation units larger than the average (the probability of being less than 3 units above average from normal distribution tables is 0.9987). Thus, if an agent is added to a sample and the impact value of this sample is more than 3 standard deviation units above the average, it can be assumed that the additive has caused this result and the result is said to be statistically significant.

For the experiments, samples of a fixed product with varying amounts of agent were prepared and the impact value of each sample was determined. The impact results were plotted against the %-additive in each sample. From this graph, a %-additive above which the impact value becomes more than 3 standard deviation units greater than the average can be determined.

Observation of these graphs (covering a wide range of products and %-additives) show that the curves, in the region where the 3 standard deviation value (critical value) is exceeded, are essentially linear with some random variation. Based upon this, a linear curve of the form $$Y=mX+b$$

where Y=impact value and x=%-additive was fitted to the data by the method of least squares. This formula was then used to calculate the %-additive at which the impact value becomes greater than the critical value.

This illustrative procedure describes using CL-20 as the explosive component and bis(hydrogenated tallow alkyl) dimethyl quaternary ammonium chloride (Arquad 2HT-75 from AKZO Chemical) as the shock sensitivity reducing agent. This procedure illustrates the preparation of a final mixture containing 99% CL-20 and 1% Arquad 2HT-75. Other concentrations are prepared by varying the proportions of the ingredients in the mixture.

Compositions comprising CL-20 and a shock sensitivity reducing agent (Arquad 2HT-75) are prepared following the procedure set forth below:

A. Weigh 0.250 grams of the Arquad 2HT-75 into a 100 ml beaker.

B. Add 5 ml $H_2O$ to provide a mixing media for coating the CL-20 crystals with the Arquad 2HT-75. Other liquids such as isopropanol will also work.

C. Stir the mixture of Arquad 2HT-75 and liquid with a rubber tipped glass tipping rod until the 2HT-75 is well dispersed.

D. Weigh 24.7500 gms of CL-20 and pour into a beaker containing the Arquad 2HT-75.

E. Stir the mixture with a rubber tipped stirring rod for about 5 minutes.

F. Place the beaker in a steam heated oven at about 200° F. for 15 minutes.

G. Remove the sample from the oven.

H. Stir the mixture with the rubber tipped glass stirring rod for 5 minutes.

I. Place the beaker in the steam heated oven (200° F.) for another 15 minutes.

J. Remove the sample from the oven and stir for 5 minutes.

K. Weigh and record the weight of the beaker.

L. Return the beaker to the oven for 15 minutes.

M. Stir for 5 minutes and weigh the beaker.

N. Continue the heating and stirring procedure until there is no weight loss after heating.

Table 1 also shows the test results using other shock sensitivity reducing compounds, identified in the Table, mixed with CL-20 in various concentrations. The agents tested are representative of the large number of compounds which are useful in this invention.

TABLE 1

| Shock Sensitivity Reducing Compound | Concentration % in CL-20 Formulations | HDC Impact Value (cm) | Calculated Concentration Required to Reach the Statistically Significant HDC Impact Value of 21.03 cm |
|---|---|---|---|
| Bis(hydrogenated tallow | 0.00 | 14.85 | 0.96% |
| alkyl)dimethyl quaternary | 0.10 | 21.70 | |
| ammonium chloride - | 1.00 | 20.80 | |
| Arquad 2HT-75 from | 2.00 | 24.20 | |
| AKZO Chemicals Inc. | 3.00 | 24.20 | |
| Distilled Monoglycerides | 0.00 | 14.85 | 1.04% |
| PA-208 from | 0.10 | 14.20 | |
| Eastman Chemical Company | 1.00 | 20.80 | |
| | 2.00 | 22.70 | |
| | 3.00 | 21.90 | |
| Sodium Alkane Sulfonate | 0.00 | 14.85 | 2.82% |

TABLE 1-continued

| Shock Sensitivity Reducing Compound | Concentration % in CL-20 Formulations | HDC Impact Value (cm) | Calculated Concentration Required to Reach the Statistically Significant HDC Impact Value of 21.03 cm |
|---|---|---|---|
| Dehydat 93P from | 0.10 | 21.90 | |
| Henkel Corporation | 1.00 | 18.80 | |
| | 2.00 | 21.90 | |
| | 3.00 | 21.90 | |
| Ethoxylated Cocoalkyl | 0.00 | 14.85 | No significant |
| Amines Kemamine AS-650 | 0.10 | 23.10 | change |
| Witco Chemical Company | 1.00 | 15.00 | |
| | 2.00 | 12.70 | |
| | 3.00 | 15.80 | |
| Trimethyl tallow alkyl | 0.00 | 14.85 | No Significant |
| quaternary ammonium | 0.10 | 15.00 | change |
| chloride - | 1.00 | 13.70 | |
| Arquad T-50 from | 2.00 | 17.50 | |
| AKZO Chemicals Inc. | 3.00 | 13.10 | |
| Hydrogenated tallow | 0.00 | 14.85 | No Significant |
| alkyl (2-ethylhexyl) | 0.10 | 13.70 | change |
| dimethyl quaternary | 1.00 | 14.20 | |
| ammonium methosulfates | 2.00 | 11.20 | |
| Arquad HTL8-MS from | 3.00 | 16.90 | |
| AKZO Chemicals Inc. | | | |
| Dimethyl di(cocoalkyl | 0.00 | 14.85 | 0.09% |
| quaternary ammonium | 0.10 | 21.90 | |
| chloride | 1.00 | 22.50 | |
| Arquad 2C-75 from | 2.00 | 21.90 | |
| AKZO Chemicals Inc. | 3.00 | 24.20 | |
| N,N,N-Tris(2-hydroxy- | 0.00 | 14.85 | No Significant |
| ethyl) tallow alkyl | 0.10 | 16.80 | change |
| ammonium acetate | 1.00 | 10.80 | |
| (Ethoquad T/13-50 | 2.00 | 8.50 | |
| from AKZO Chemicals Inc. | 3.00 | 8.10 | |
| Methyl bis(2-Hydroxy- | 0.00 | 14.85 | No Significant |
| ethyl) cocoalkyl | 0.10 | 15.80 | change |
| quaternary ammonium | 1.00 | 12.70 | |
| chloride | 2.00 | 16.90 | |
| Ethoquad C/12-75 | 3.00 | 16.90 | |
| Trialkyl polyalkoxy- | 0.00 | 14.85 | No Significant |
| alkene quaternary | 0.10 | 16.20 | change |
| ammonium chloride | 1.00 | 18.80 | |
| MARKSTAT AL 12 | 2.00 | 16.20 | |
| Witco Chemical Corp. | 3.00 | 15.80 | |
| Polyether (Trade | 0.00 | 14.85 | No Significant |
| Secret) | 0.10 | 15.80 | change |
| MARKSTAT AL-14 | 1.00 | 14.20 | |
| Witco Chemical Corp. | 2.00 | 12.50 | |
| | 3.00 | 14.20 | |
| Quaternary Ammonium | 0.00 | 14.85 | No Significant |
| Compounds (Proprietary) | 0.10 | 11.40 | change |
| Statiacide 3000G | 1.00 | 12.50 | |
| Witco Chemical Corp. | 2.00 | 13.70 | |
| | 3.00 | 7.50 | |
| Distilled Monoglycerides | 0.00 | 14.85 | No significant |
| Myverol 18-99 | 0.10 | 16.20 | change |
| Eastman Chemical Company | 1.00 | 16.40 | |
| | 2.00 | 15.80 | |
| | 3.00 | 15.80 | |
| Ethoxylated Tallow Amines | 0.00 | 14.85 | No Significant |
| Ethomeen T/12 | 0.10 | 13.80 | change |
| AKZO Chemicals Inc. | 1.00 | 10.00 | |
| | 2.00 | 15.80 | |
| | 3.00 | 16.20 | |
| Mono-diglycerides | 0.00 | 14.85 | 3.74% |
| Glycolube 140 | 0.10 | 9.20 | |
| Glyco Inc. | 1.00 | 15.00 | |
| | 2.00 | 16.90 | |
| | 3.00 | 19.20 | |
| Dicarboxylic Acid Ester | 0.00 | 14.85 | No Significant |
| of Saturated Aliphatic | 0.10 | 23.10 | change |
| Alcohols-Loxiol G60 | 1.00 | 20.80 | |
| Henkel Corporation | 2.00 | 16.90 | |
| | 3.00 | 15.80 | |
| Fatty Acid Ester | 0.00 | 14.85 | 2.20% |

TABLE 1-continued

| Shock Sensitivity Reducing Compound | Concentration % in CL-20 Formulations | HDC Impact Value (cm) | Calculated Concentration Required to Reach the Statistically Significant HDC Impact Value of 21.03 cm |
|---|---|---|---|
| (Proprietary) | 0.10 | 20.80 | |
| Dehydat 8312 | 1.00 | 19.20 | |
| Henkel Corporation | 2.00 | 20.80 | |
| | 3.00 | 21.90 | |
| Quaternary Ammonium | 0.00 | 14.85 | 2.90% |
| Compound-Cling Free | 0.10 | 14.20 | |
| Extract-Proprietary | 1.00 | 17.50 | |
| Beckner Inc. | 2.00 | 17.50 | |
| | 3.00 | 21.90 | |
| Partial Polyglycerol | 0.00 | 14.85 | No Significant |
| Fatty Acid Ester | 0.10 | 11.20 | change |
| (Proprietary) | 1.00 | 16.90 | |
| Dehydat VAP 1726 | 2.00 | 13.10 | |
| Henkel Corporation | 3.00 | 14.20 | |

The invention has been described in detail with particular reference to preferred embodiments thereof, but it will be understood that variations and modifications will be effected within the spirit and scope of the invention.

I claim:

1. High energy explosive formulation characterized by reduced susceptibility to impact and sympathetic detonation due to shock forces, said composition comprising CL-20, and a long chain amine shock sensitivity reducing agent, said shock sensitivity reducing agent being present in an amount effective to impart an increase in HDC Impact Value to the formulation which is statistically significant.

2. Formulation of claim 1 wherein the HDC Impact Value is at least 21.03 centimeters.

3. An explosive composition according to claim 1, wherein the shock sensitivity reducing agent is a long chain amine selected from the group consisting of bis(2-hydroxyethyl) tallow alkyl amine; $(HOCH_2CH_2)_2NR$ where R is a $C_{12}$–$C_{18}$ carbon chain;

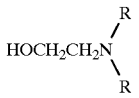

where R is a $C_{12}$–$C_{18}$ carbon chain; $[H(OCH_2CH_2)_nOCH_2CH_2]_2NR$ where R is a $C_{12}$ to $C_{18}$ carbon chain and n is 1–150; and

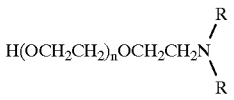

where R is a $C_{12}$ to $C_{18}$ carbon chain and n is 1 to 150.

4. An explosive composition according to claim 3, wherein the shock sensitivity reducing agent is water soluble.

5. An explosive composition according to claim 1, wherein the shock sensitivity reducing agent is an ethoxylated cocoalkyl amine with a $C_8$–$C_{18}$ cocoalkyl group.

6. An explosive composition according to claim 5, wherein the shock sensitivity reducing agent is water soluble.

7. An explosive composition according to claim 1, wherein the shock sensitivity reducing agent is a long chain amine selected from the group consisting and a dialkylethanolamine in which the alkyl group contains 12 to 18 carbon atoms, alkyl poly ethoxy ethylamines in which the alkyl group contains 12 to 18 carbon atoms, and ethoxylated cocoamine.

8. An explosive composition according to claim 7, wherein the shock sensitivity reducing agent is water soluble.

* * * * *